United States Patent [19]

Nishida

[11] Patent Number: 4,627,373

[45] Date of Patent: Dec. 9, 1986

[54] CONSTRUCTION FOR COUPLING DECK TO HULL OF SMALL-SIZED MARINE CRAFT

[75] Inventor: Hiroshi Nishida, Miki, Japan

[73] Assignee: Kawasaki Jukogyo Kabushiki Kaisha, Kobe, Japan

[21] Appl. No.: 698,427

[22] Filed: Feb. 5, 1985

[30] Foreign Application Priority Data

Feb. 8, 1984 [JP] Japan ..... 59-17171[U]

[51] Int. Cl.[4] ..... B63B 5/24

[52] U.S. Cl. ..... 114/182; 114/219; 114/357

[58] Field of Search ..... 114/39.1, 182, 219, 114/355–359, 361; 440/38

[56] References Cited

U.S. PATENT DOCUMENTS

| | | | |
|---|---|---|---|
| 1,361,902 | 12/1920 | Porteous | 114/219 |
| 3,019,758 | 2/1962 | Erkert | 114/219 |
| 3,109,405 | 11/1963 | Nusinoff | 114/219 |
| 3,110,066 | 11/1963 | Ward et al. | 114/219 |
| 3,315,284 | 4/1967 | Ludlow | 114/357 |

FOREIGN PATENT DOCUMENTS

| | | | |
|---|---|---|---|
| 71682 | 6/1981 | Japan | 114/182 |
| 56-40627 | 9/1981 | Japan | 114/357 |
| 965055 | 7/1964 | United Kingdom | 114/357 |

*Primary Examiner*—Trygve M. Blix
*Assistant Examiner*—Stephen P. Avila
*Attorney, Agent, or Firm*—Leydig, Voit & Mayer, Ltd.

[57] ABSTRACT

A deck-hull coupling construction for a small-sized marine craft which has bumpers extending upwardly and downwardly from the coupling. The upwardly extending bumper is constituted by upwardly bent outer extremity of a deck flange which extends horizontally from the peripheral edge of the deck, while the downwardly extending bumper is constituted by a downwardly bent outer extremity of a hull flange which extends horizontally from the peripheral edge of the hull. These bumpers exhibit a superior shock absorbing effect and prevents a protector from coming off therefrom.

2 Claims, 9 Drawing Figures

CONSTRUCTION FOR COUPLING DECK TO HULL OF SMALL-SIZED MARINE CRAFT

BACKGROUND OF THE INVENTION

1. Field of the Invention

The present invention relates to a construction for coupling the deck and the hull of a small-sized marine craft to each other and, more particularly, to an improved construction of a bumper formed by the coupling flanges projecting from the peripheral edges of the deck and the hull.

2. Description of the Prior Art

The term "marine craft" is used in this specification to generally mean such power-propelled boats or marine vehicles adapted to glide on the water surface under the control by a rider who stands or sits on such crafts. The marine craft is generally composed of a hull constituting the lower part of the craft and a deck covering the top of the hull. The hull and the deck are provided with coupling flanges projecting substantially horizontally therefrom. These flanges are superposed and bonded to each other by an adhesive, thus coupling the hull and the deck to each other. The outer extremities of the superposed flanges are bent to form a bumper for absorbing any shock which may be caused when, for example, the marine crafts collides with a quay wall, thus protecting the rider and the marine craft.

This conventional bumper construction, however, cannot provide sufficiently large shock absorbing effect because the bumper constituted by laminated flanges exhibits only a small deflection when shocked. Usually, the bumper is covered with a plastic protector which is intended for enhancing the shock absorbing effect and imparting an attractive appearance. Since the outer extremities of the flanges constituting the bumper are bent downwardly, there is no anchoring portion which would retain the protector on the upper side of the bumper, so that the protector is liable to come off. Any fixing means such as adhesive and bolts for preventing the protector from coming off makes it difficult to renew the protector.

SUMMARY OF THE INVENTION

Accordingly, an object of the invention is to provide an improved hull-deck coupling construction for small-sized marine crafts which is capable of overcoming the above-described problems of the prior art.

To this end, the invention proposes a novel coupling construction having the following features (1) to (4):

(1) a deck flange extending horizontally from the peripheral edge of the deck;

(2) a hull flange extending horizontally from the peripheral edge of the hull and adapted to underlie the deck flange;

(3) an upwardly extending deck bumper constituted by an upwardly bent outer extremity of the deck flange; and (4) a downwardly extending hull bumper constituted by an downwardly bent outer extremity of the hull flange.

The bumper provided in this coupling construction offers a large shock absorbing capacity and effectively protects the marine craft and the rider. In addition, a protector can be attached easily to the bumper without requiring any specific fixing means such as a bond or rivets, so that the renewal of the protector also is facilitated. The protector is effectively retained by the bumpers extending upwardly and downwardly so that the protector is effectively prevented from coming off unintentionally.

DESCRIPTION OF THE PREFERRED EMBODIMENTS

Before turning to the description of the preferred embodiments, an explanation will be made as to a typical prior art in order to clarify the disadvantages of the prior art and, hence, the advantages of the invention.

Figure 1:
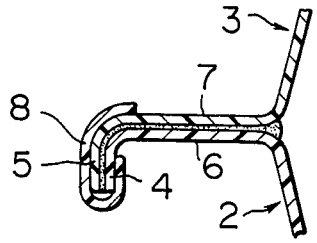
FIG. 1 PRIOR ART
FIG. 1 is a sectional view of a conventional construction for coupling the deck and the hull of a small-sized marine craft.

Referring to FIG. 1 showing a prior art, coupling flanges 6 and 7 extend substantially horizontally from the peripheral edges of a hull 2 and a deck 3, respectively, and are superposed and bonded to each other. The outer extremities 4, 5 of the superposed flanges 6, 7 are bent downwardly to form an integral bumper. A protector 8 is attached to the bumper in order to enhance the shock absorbing effect and to provide an attractive appearance. As stated before, the bumper constituted by the ends of integrated flanges does not provide sufficient shock absorbing effect, and the protector 8 tends to loosen and come off the bumper which is directed downwardly.

These problems, however, are overcome by the invention as will be understood from the following description.

Figure 2:
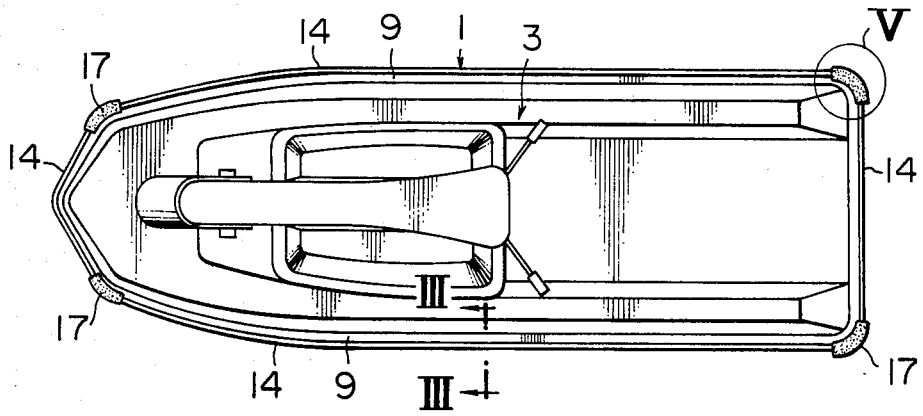
FIG. 2 is a plan view of a small-sized marine craft which incorporates a coupling construction in accordance with the invention.
Figure 3:
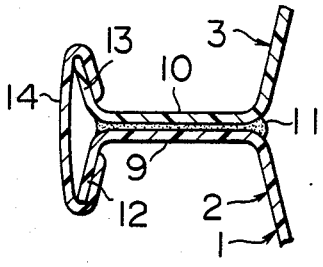
FIG. 3 is a sectional view taken along the line III—III of FIG. 2, showing an embodiment of a coupling construction in accordance with the invention.

FIG. 2 shows in plan view a small-sized marine craft to which the invention is applied. The marine craft is adapted to glide on water surface under the control of a rider who stands or sits on the craft. The marine carft generally denoted by a numeral 1 has a hull 2 constituting the lower portion and a deck 3 covering the top of the hull 2. Both the hull 2 and the deck 3 are made of an FRP (Fiber Reinforced Plastic) material. As will be seen from FIG. 3, horizontal coupling flanges 9 and 10 are projected from the peripheral edges of the hull 2 and the deck 3. These flanges extend over the entire periphery of the marine craft 1 as shown in FIG. 2.

These flanges 9 and 10 are superposed and bonded to each other by an adhesive 11. The outer extremity of the lower flange 9 is bent downwardly such as to constitute a hull bumper 12, while the outer extremity of the upper flange 10 is bent upwardly such as to constitute a deck bumper 13. More specifically, the bumpers 12 and 13 are slightly inclined outwardly with respect to the vertical plane, and are extended over the entire periphery of the marine craft 1 except some portions which will be mentioned later.

Figure 4:
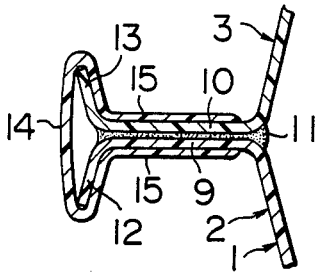
FIG. 4 is a sectional view of a modification having a different form of a protector.

The bumpers 12 and 13 in the assembled state are covered by a protector 14 having a C-shaped cross-section and made of vinyl chloride. The protector 14 can have flaps 15 which fit on the horizontal coupling flanges 9 and 10 as shown in FIG. 4.

Figure 5:
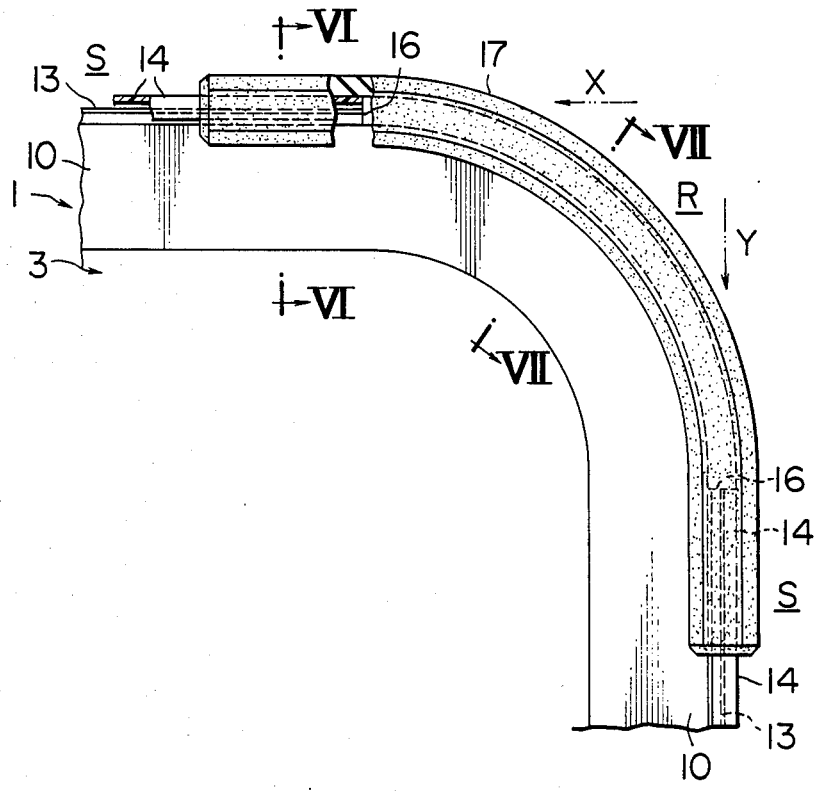
FIG. 5 is an enlarged view of a portion encircled by a circle V in FIG. 2.

In the described embodiment, four separate protectors 14 are used to cover the bumper at the bow portion, port-side portion, stern portion and the starboard-side portion of the marine craft 1, respectively. How the protector is attached is shown in detail in FIG. 5 which is an enlarged view of the starboard stern portion of the marine craft encircled by a circle V in FIG. 2, by way of example.

The bumpers 12, 13 are formed only along the linear or curvilinear portions S of the marine craft when viewed in plan, and are not provided on the rounded portions R. More specifically, as will be seen from sectional view in FIG. 6, the linear or curvilinear portion S has bumpers 12 and 13 which extend downwardly and upwardly. However, the rounded portion R lacks such bumpers projecting from the horizontal flat flanges 9, 10, as will be seen from FIG. 7. Therefore, for fitting the protector 14 to the starboard side of the marine craft, the protector 14 is inserted from the stern side through the portion 16 devoid of the bumpers 12, 13, as indicated by an arrow X, such as to cover the bumpers 12, 13 in the manner shown in FIG. 6. Similarly, the protector 14 on the stern is fitted through the portion devoid of the bumpers, e.g., from the starboard side as indicated by an arrow Y.

Figure 6:
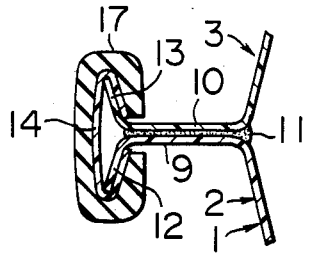
FIG. 6 is a sectional view taken along the line VI—VI of FIG. 5.
Figure 7:
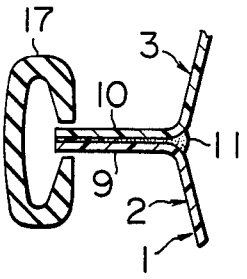
FIG. 7 is a sectional view taken along the line VII—VII of FIG. 7.

A reference numeral 17 designates a fender made of a soft rubber. As will be seen from FIG. 2, fenders 17 are attached to four rounded portions R which are most likely to collide with other object such as the quay wall. These fenders 17 are fitted such as to cover the adjacent ends of the protectors 14, in a manner as shown in FIG. 6.

The hull-deck coupling construction in accordance with the invention offers the following advantages.

As shown, the hull bumper 12 and the deck bumper 13 are extended apart from each other, i.e., downwardly and upwardly, respectively, from the ends of the flat portions of the coupling flanges 9, 10. Therefore, if each of the bumpers 12, 13 has the same vertical height as the conventional bumper shown in FIG. 1, the overall height of the bumper construction provided by both bumpers 12, 13 is about double the height of the conventional bumper. Therefore, a sufficiently large effective bumper area is obtainable even when each of the bumpers 12, 13 has a height which is reduced as compared with that of the conventional bumper.

In addition, since two bumpers are not superposed but are extended apart from each other, each bumper can be resiliently flexed to a sufficiently large degree thus effectively absorbing any shock, unlike the conventional structure in which the bumper having laminated structure exhibits a large rigidity which suppresses the resilient deflection and shock absorption by the bumper.

It is to be pointed out that the bumpers 12 and 13 extending substantially vertically apart from each other well retain the protector 14 fitting thereon, so that the protector 14 can be stably held on the bumpers simply by being slided onto the bumpers. Thus, the protector can be mounted easily without necessitating any specific fixing means such as an adhesive or rivets, and can be renewed without substantial difficulty.

Figure 8:
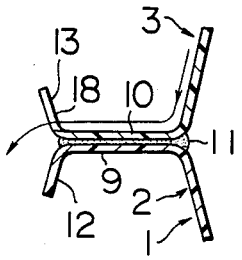
FIG. 8 is a sectional view of another embodiment in which slits are formed in the deck bumper.
Figure 9:
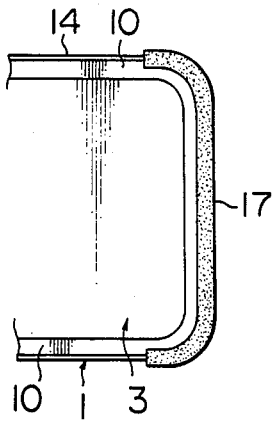
FIG. 9 is a plan view of the stern portion of the marine craft having a different form of protector.

FIG. 8 shows another embodiment in which the deck bumper 13 is provided with slits 18 so as to allow the discharge of water, sand and other dust which may otherwise be accumulated in the recess on the deck flange 10. Preferably, a plurality of slits 18 are formed in the deck bumper 13 at suitable portions around the deck 3. The fender 17 may be attached to cover the whole breadth along the stern as shown in FIG. 9, for the purpose of attaining a higher safety of the rider when stepping onto and off the marine craft.

What is claimed is:

1. A deck-hull coupling construction for a small-sized marine craft comprising:

a deck flange extending horizontally from a peripheral edge of a deck of said marine craft;

a hull flange extending horizontally from a peripheral edge of a hull of said marine craft and adapted to underlie said deck flange;

said flanges having a parallel spaced relationship providing flange planar horizontal surface areas;

a layer of adhesive of substantially uniform thickness between said facing areas for bonding said flanges to each other;

an upwardly extending deck bumper constituted by an upwardly bent outer extremity of said deck flange;

a downwardly extending hull bumper constituted by a downwardly bent outer extremity of said hull flange, said upwardly extending and downwardly extending bumpers constituted by extremities of said deck and hull flanges extending along substantially the entire periphery of the craft and terminating at sharply rounded peripheral portions of said craft, leaving gaps in said bumpers;

protector means having a C-shaped cross-section and fitting around both said extremities and the periphery of said deck bumper and said hull bumper and retained by said extremities along the periphery of said bumpers as said parallel, bonded flanges flex either upwardly or downwardly upon the periphery of the bumpers being struck by another object; and C-shaped fenders extending coextensive with said gaps and attached to end portions of said C-shaped protectors adjacent said caps.

2. A deck-hull coupling construction for a small-sized marine craft comprising:

a deck flange extending horizontally from a peripheral edge of a deck of said marine craft;

a hull flange extending horizontally from a peripheral edge of a hull of said marine craft and adapted to underlie said deck flange;

an upwardly extending deck bumper constituted by upwardly bent outer extremity of said deck flange;

a downwardly extending hull bumper constituted by downwardly bent outer extremity of said hull flange;

protector means having a C-shaped cross-section and fitting around both said extremities and the periphery of said deck bumper and said hull bumper and retained by said extremities along spaced portions of the periphery of said bumpers;

said upwardly extending deck bumper and downwardly extending hull bumper extending peripherally of said craft and terminating adjacent sharply rounded corners of said craft leaving gaps in said bumpers, said protector means extending substantially coextensively with said bumpers; and fender means having a C-shaped cross-section and extending along said gaps in said bumpers to cover said flanges and attached to end portions of said protector means adjacent said gaps.

* * * * *